US007467486B2

(12) United States Patent
Kaoh

(10) Patent No.: US 7,467,486 B2
(45) Date of Patent: Dec. 23, 2008

(54) METHOD AND APPARATUS FOR SIMULATING THE APPEARANCE OF A NEON SIGN

(76) Inventor: Andy K. F. Kaoh, 12231 Singing Wood Dr., Santa Ana, CA (US) 92705

( * ) Notice: Subject to any disclaimer, the term of this patent is extended or adjusted under 35 U.S.C. 154(b) by 78 days.

(21) Appl. No.: 11/438,663

(22) Filed: May 22, 2006

(65) Prior Publication Data

US 2007/0283604 A1 Dec. 13, 2007

(51) Int. Cl.
*G09F 13/28* (2006.01)

(52) U.S. Cl. ..... 40/551; 40/552

(58) Field of Classification Search ..... 40/550, 40/551, 552, 541
See application file for complete search history.

(56) References Cited

U.S. PATENT DOCUMENTS

| | | | | | |
|---|---|---|---|---|---|
| 1,820,913 | A | * | 9/1931 | Kelly et al. | 40/552 |
| 2,923,080 | A | * | 2/1960 | Spangler | 40/552 |
| 4,111,520 | A | | 9/1978 | Bernal G. | |
| 4,140,405 | A | * | 2/1979 | Shapiro et al. | 40/552 |
| 4,298,869 | A | | 11/1981 | Okuno | |
| 4,376,946 | A | | 3/1983 | Kaminow et al. | |
| 4,471,350 | A | * | 9/1984 | Chow | 345/43 |
| 4,597,033 | A | | 6/1986 | Meggs et al. | |
| 4,607,317 | A | | 8/1986 | Lin | |
| 4,767,172 | A | | 8/1988 | Nichols et al. | |
| 4,785,567 | A | | 11/1988 | Consiglio | |
| 4,891,896 | A | | 1/1990 | Boren | |
| 4,976,057 | A | | 12/1990 | Bianchi | |
| 4,996,632 | A | | 2/1991 | Aikens | |
| 5,057,981 | A | | 10/1991 | Bowen et al. | |
| 5,146,704 | A | * | 9/1992 | Dugan | 40/552 |
| 5,410,453 | A | | 4/1995 | Ruskouski | |
| 5,416,679 | A | | 5/1995 | Ruskouski et al. | |
| 5,459,955 | A | | 10/1995 | Ruskouski et al. | |
| 5,604,480 | A | * | 2/1997 | Lamparter | 362/478 |
| 5,640,792 | A | | 6/1997 | Smith et al. | |
| 5,796,331 | A | * | 8/1998 | Lamparter | 340/433 |
| 5,842,297 | A | | 12/1998 | Tung | |
| 5,887,968 | A | | 3/1999 | Logan | |
| 5,921,652 | A | | 7/1999 | Parker et al. | |
| 5,950,340 | A | | 9/1999 | Woo | |
| 5,964,051 | A | * | 10/1999 | Loeber et al. | 40/570 |
| 6,158,882 | A | | 12/2000 | Bischoff, Jr. | |
| 6,173,517 | B1 | * | 1/2001 | Eibner et al. | 40/544 |
| 6,283,612 | B1 | | 9/2001 | Hunter | |
| 6,354,714 | B1 | | 3/2002 | Rhodes | |
| 6,361,186 | B1 | | 3/2002 | Slayden | |
| 6,592,238 | B2 | | 7/2003 | Cleaver et al. | |
| 6,735,893 | B2 | * | 5/2004 | Wolf | 40/591 |
| 2002/0017045 | A1 | * | 2/2002 | Weiss et al. | 40/580 |
| 2004/0255497 | A1 | * | 12/2004 | Venkataraman et al. | 40/551 |
| 2005/0210722 | A1 | * | 9/2005 | Graef et al. | 40/452 |

* cited by examiner

*Primary Examiner*—Gary C Hoge

(57) ABSTRACT

A plurality of light emitting diodes (LEDs) disposed in a customized housing produce bright colored light simulating the appearance of a neon sign. The housing includes an opaque portion that reflects light from the LEDs and a translucent portion shaped in the form of an image or lettering that diffuses light from the LEDs. The inside surface of the opaque portion has a polished reflective surface while the outside surface has a dull textured surface. Light emanating from the LEDs propagates through the translucent portion of the housing appearing to a viewer as a bright uniform and colorful light similar in appearance to the light emitted from a neon sign.

12 Claims, 6 Drawing Sheets

METHOD AND APPARATUS FOR SIMULATING THE APPEARANCE OF A NEON SIGN

BACKGROUND OF THE INVENTION

1. Field of the Invention

The invention relates generally to signage devices, and more particularly, to lighting devices that simulate the appearance of a neon gas light sign with solid state light emitters.

2. Description of Related Art

Advertisers and business establishments make extensive use of neon lights to convey a message and their appearances have become acceptable to customers. The bright, uniform, and colorful light distribution emitted from a neon light attracts attention making neon signs a good advertising medium. Neon signs have been used extensively for close to one hundred years.

To construct a segment of a neon sign, an artisan can heat lead glass tubing using a small blow torch and can shape the lead glass tube into a desired shape. During the shaping process, the artisan attaches an electrode to each end of the tube. The artisan then attaches the tube to a manifold with a high quality vacuum pump. The pump evacuates air from the tube. During evacuation a high voltage pulse is applied to the electrodes resulting in arcing from one electrode the other creating a high temperature inside the tube. Dirt and other impurities gasify and are pumped out of the tube resulting in a very clean interior vacuum. The artisan then introduces into the tube one or more noble gasses such as Neon, Krypton, Xenon, Argon or Helium.

The gasses introduced into the tube effect the neon light color. Neon produces an orange red glow. Argon with a droplet of mercury produces an ultraviolet light. The interior can also be coated with a variety of phosphors that react to ultraviolet light and emit colored light in the visible spectrum. These components can provide polluting material that should be removed upon disposal of the signs.

After all the segments of the neon sign have been formed the artisan assembles the segments into a single structure. The artisan wires each segment of the neon sign by electrically coupling the electrodes to a transformer that steps the voltage up from 120 volts to somewhere between 3,000 and 15,000 volts.

Light Emitting Diodes (LEDs) convert electrical energy into distinct colors of light. Tradition gallium arsenide LEDs emit red light when electrically stimulated. Advances in LED technology and material science have enabled semiconductor manufacturers to create very bright LEDs in a variety of colors. LED lighting offers numerous advantages over neon lighting. LEDs do not require transformers that step up voltages to dangerous levels instead LED's operate at low potentials of 3 to 24 volts. LED's can easily be packaged in a variety of safe materials and do not require large breakable tubular lead crystal structures. LED brightness can easily be controlled with very quick response allowing for visual effects not possible with neon lights. LED's may also be mass produced at low cost.

Those concerned with the use of neon signs have long recognized the need for more controllable, safer, less fragile and less expensive neon signs. The present invention significantly advances the prior art by simulating the bright uniform colorful appearance of a neon sign while using more efficient LED technology in unique housing configurations.

SUMMARY OF THE INVENTION

The present invention simulates the appearance of a neon sign. The invention comprises multiple housing portions composed of opaque and translucent materials and a plurality of LEDs arranged to produce light that propagates through the translucent portion of the housing. The housing portions mate to form a single rigid structure that surrounds the plurality of LEDs. The translucent portion has a shape that conveys a message via image, icon, lettering or other indicia.

The opaque portion of the housing has a shiny interior surface that reflects light emitted from the LEDs. The outer portion of the housing has a dark textured appearance making the surface appear flat and dull in stark contrast with the illuminated translucent portion. This contrast minimizes the visibility of the opaque portion of the housing creating a realistic neon like illumination particularly at night or in a dark setting.

The housing has a form that profiles the contours of the message to be conveyed. This contoured shape creates a more authentic neon sign like appearance. The housing is compartmentalized to focus the LED energy and prevent unwanted mixing of light from different colored LEDs.

One embodiment of the invention has an open structure wherein the desired message is cantilevered to permit a viewer to see through openings in the supporting housing adjacent the openings to further emphasize a neon sign effect.

A control circuit inside the housing controls the voltage applied to the LEDs. A control panel mounted on the outside of the housing provides user input to the control circuit. The control panel allows a user to select and control visual effects such as flashing and flash rate. A direct current (DC) port on the control panel receives electrical power for the control circuit and the LEDs. An alternating current (AC) adapter cable converts 120 volt AC power into DC power for powering the control circuit and the LEDs through the DC port.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

The exact nature of this invention as well as its objects and advantages will be readily understood upon consideration of the following specification as related to the attendant drawings wherein like reference numeral throughout the drawings indicate like parts, and wherein.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
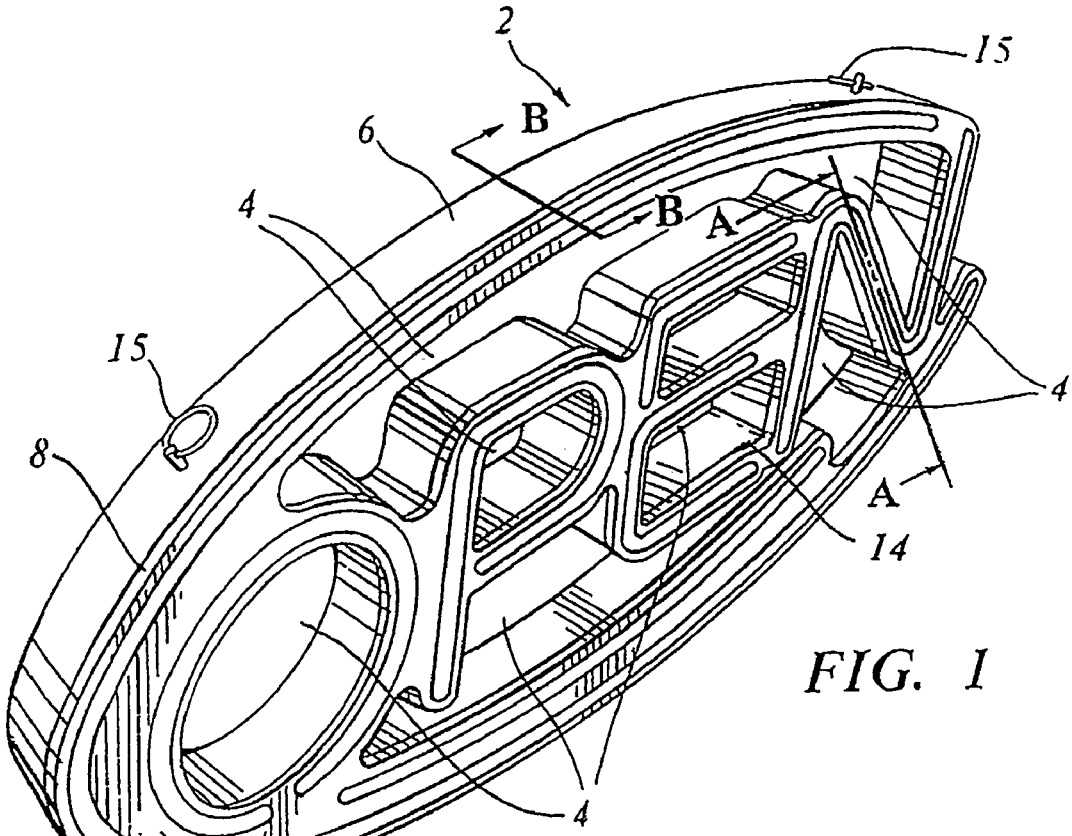
FIG. 1 is a perspective view of a preferred embodiment of the simulated neon sign.
Figure 2:
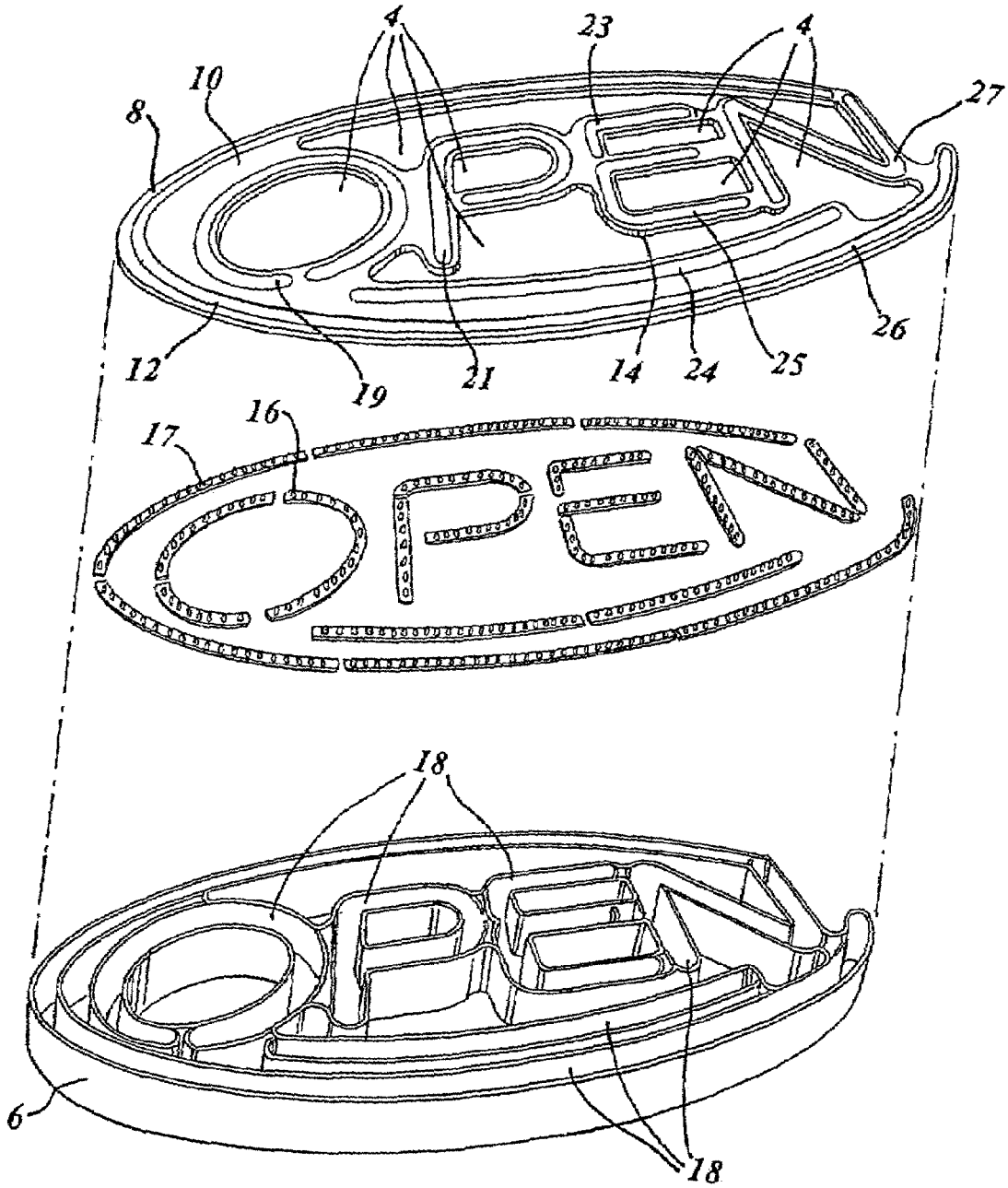
FIG. 2 is an exploded view of the simulated neon sign of FIG. 1.

FIGS. 1 and 2 show a first embodiment of the neon sign simulator. The neon sign simulator includes a housing 2 formed approximately in the shape of indicia of a message to be conveyed. In this case, the indicia include the lettering "OPEN" with an underlining and an oval motif. The housing 2 defines a plurality of openings 4 that complement the lettering and design of the message and permits a viewer to see through the adjacent opening. This reinforces the concept of a neon sign with subjectively bent tubes at a fraction of the cost.

The housing has a base 6 with a textured outer surface to create a dull opaque appearance. The base 6 is composed of a lightweight rigid plastic such as Acrylonitrile-Butadiene Styrene (ABS) with black pigment. A cover member 8 mates with the base 6 to complete the housing 2. The cover member 8 is composed of a lightweight sheet of plastic such as sanded or frosted acrylic with filler providing the cover member 8 with a textured translucent appearance. The cover member 8 is cut to complement the opening 4 and base 6.

A silk screened inked portion 10 of the cover member 8 is not light transmissive, and forms an opaque template of the indicia of the message to be conveyed. First un-inked portions 12 shaped in the form of the indicia of the message to be conveyed provide surface areas for illumination (explained hereinafter). Second un-inked portions 14 complementary to the first un-inked portions 12 and located on the sides of the cover member 8 provide surface areas for illumination that cooperate to create a three dimensional visual effect emulating a bright glow having a halo characteristic of neon lights. Two ring posts 15 mounted on the base 6 provide convenient attaching structures for hanging chain fasteners.

In this embodiment the cover member 8 is composed of a frosted or sanded acrylic. The un-inked portions 12 and 14 of the cover member 8 act as diffusive lenses for light. Any suitable material that propagates and diffuses light may be substituted for the frosted or sanded acrylic, including plastic with filler particles.

The textured outer surface of the base 6 with its dull opaque appearance minimizes the visibility signature of the base 6 when the first and second un-inked portions 12 and 14 of the cover member 8 are illuminated. The bright colored light emitted is contrasted against the hard to see base 6 and makes each of the first un-inked portions 12 appear like an independent bright neon lamp segment. The plurality of openings 4 creates an illusion of transparency allowing a viewer to see objects on the other side of the housing 2. This see through characteristic simulates the look of the federated lamp segments of a neon sign. The second un-inked portion 14 emits diffused light perpendicular to the diffused light emitted from the first un-inked portions 12 emulating the bright glow with halo characteristic of a neon signs.

The message to be conveyed by the sign through the "OPEN" lettering, underlining and oval motif is exemplary. The housing 2 may be constructed, and the cover member 8 inked, to convey any message through any indicia including lettering, images and icons.

The inked portion 10 of the cover member may be inked using a silk screening process. The inked portion 10 of the cover member 8 may also be rendered opaque through the use of dark paint bonding an opaque material to the cover member 8 or a masking template sandwiching the cover member 8.

FIG. 2 shows an exploded view of the neon sign simulator. The neon sign includes the cover member 8, a printed circuit board (PCB) 17, and the base 6. The cover member 8 has a large flat surface area with a plurality of openings 4 that complement the lettering and design. The cover member 8 is partially inked with a dark opaque ink forming a template of indicia of a message to be displayed. The first un-inked portions 12 with frosted or sanded acrylic surfaces define discrete simulated neon light segments. The first un-inked portions 12 include an "O" 19, a "P" 21, an upper "E" 23, a lower "E" 25, "N" 27, an underline 24 and an oval motif 26. The second un-inked portions 14 radiate light perpendicular to the first unlinked portions 12 providing a neon like visual effects.

Figure 8:
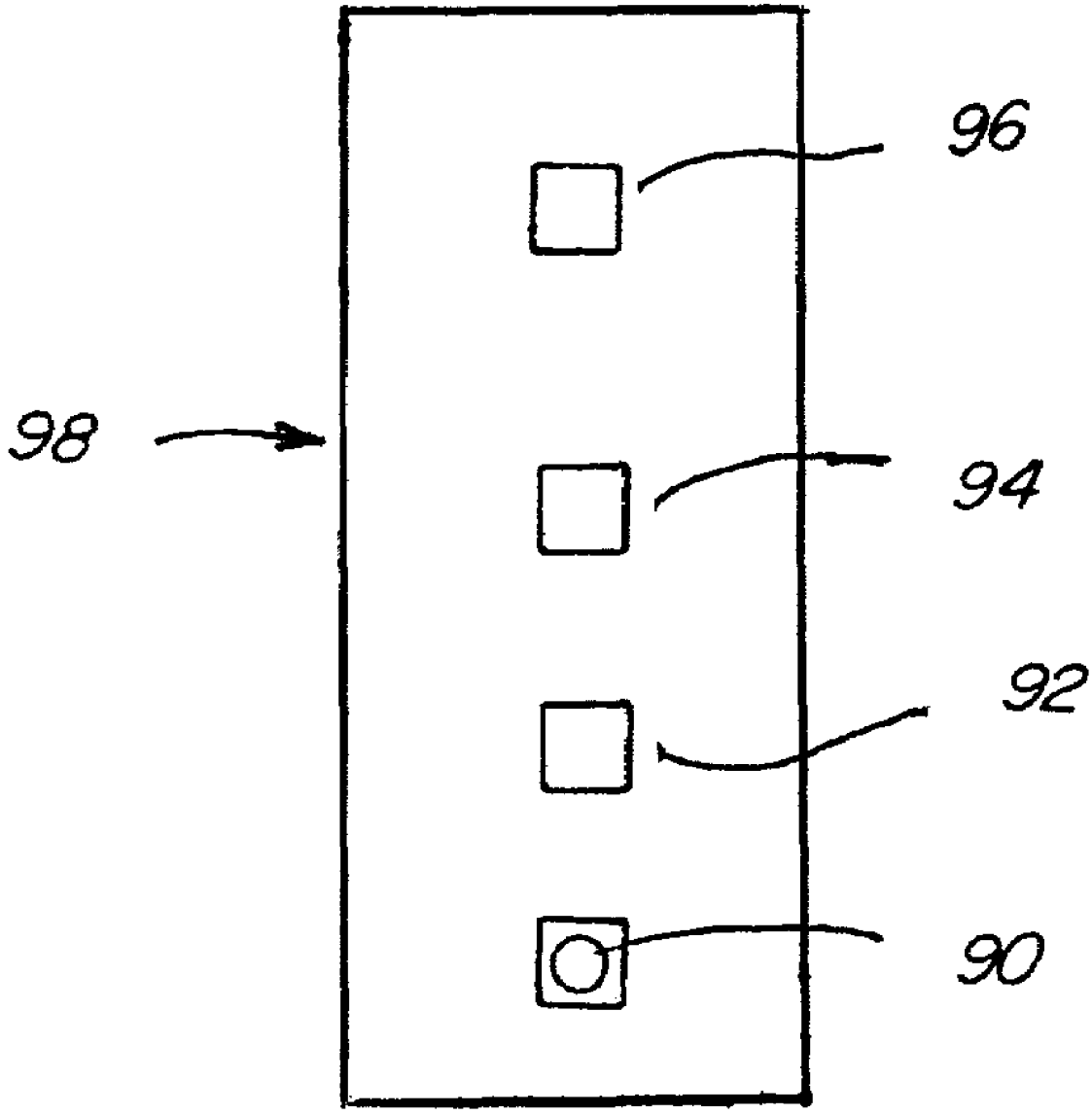
FIG. 8 is a schematic illustration of a control panel.

The PCB 17 has the same shape as the housing 2 with a plurality of LED's 16 mounted on the surface. The LEDs 16 provide illumination for the neon sign. The LED's 16 may be of one or more colors. For example, the LEDs 16 that form the lettering "OPEN" may be red and the LEDs 16 forming the underline and oval motif may be blue. In FIG. 8, a power and control circuit (not shown) accepts DC power at an input port 90 and control inputs 92, 94, and 96 from a control panel 98, which is shown schematically without defining a location on the housing 2, to provide electrical signals to the PCB 17 and the LEDs 16.

Using the control panel 98 in FIG. 8. a user can turn the LEDs 16 on using control input 92, command the LEDs 16 to flash using control input 96, or adjust the flash rate using control input 94. The use of the control panel 98 to control a variety of visual effects such as sequencing, dimming, auto start and auto shutdown is also contemplated.

The base 6 features multiple concavities 18 that house segments of the PCB 17. The interior surfaces of the concavities 18 have a smooth texture that reflects light emitted from the LEDs 16.

Figure 3:
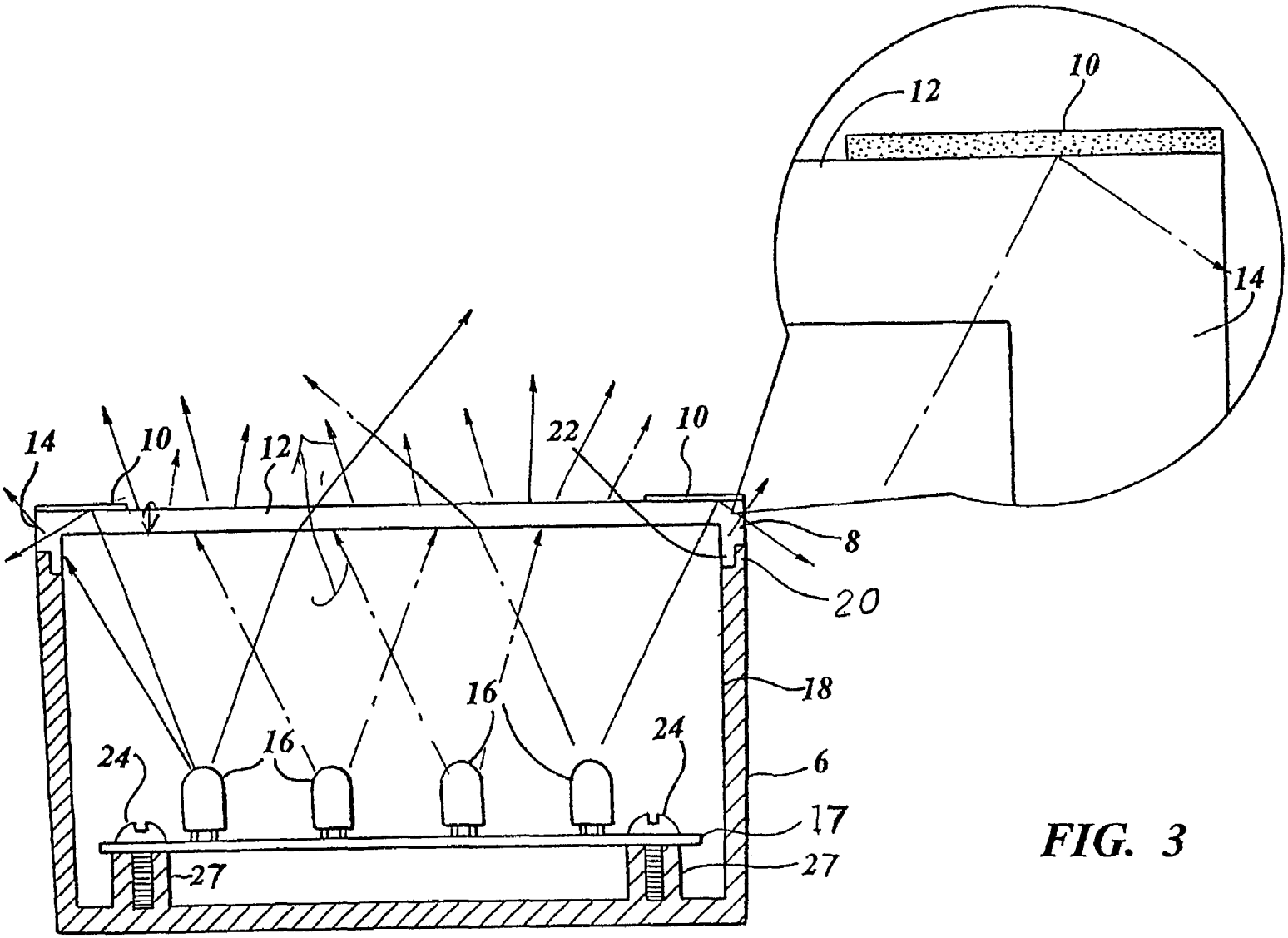
FIG. 3 is an A-A cross section view of the simulated neon sign of FIG. 1.

FIG. 3 shows an A-A cross section of FIG. 1. The cover member 8 has inner edges 22 that mate with the inner edges 20 of the base 6. The cover member 8 inner edges 22 and the base 6 inner edges 20 can be bonded together using ultrasound technology for further securing the cover member 8 to the base 6. The PCB 17 is mounted to the base 6 with screws 24 that engage threaded mounting posts 27. The LEDs 16 are mounted on the PCB 17. The LEDs are embedded in the concavity 18 which has a dark polished surface that reflects light from the LEDs 16. Light emitted from the LEDs 16 travels through the first un-inked portions 12 and the second un-inked portions 14 of the cover member 8 while diffusing in the process. The second un-inked portion 14 substantially perpendicular to the first un-inked portion 12 provides a three dimensional lighting effect. The inked portion 10 defining the indicia contours helps create this effect.

Inked portions 10 provide regions of non-transmissiveness in the cover member 8. The inked portions 10 define the precise contours of the lettering and the design. The diffused light emanating from the first and second un-inked portions 12, 14 of the cover member 8 appears to an observer as a bright uniform light similar to the light emitted from a light segment of a conventional neon light.

Figure 4:
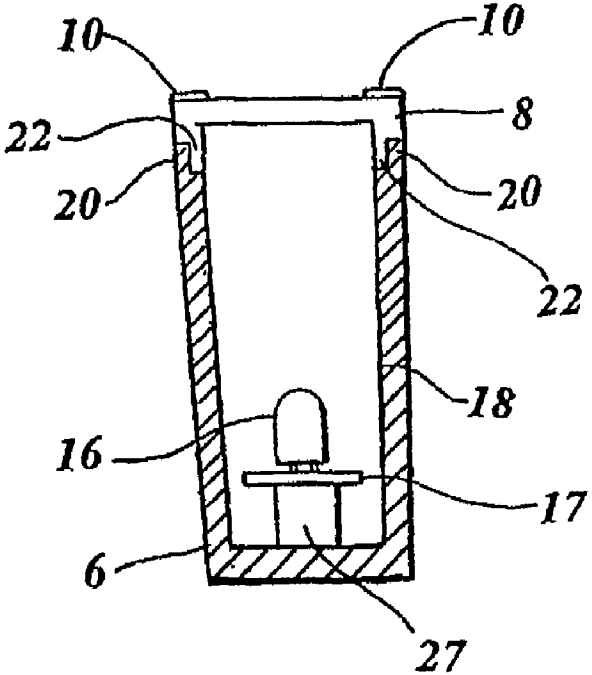
FIG. 4 is a B-B cross section view of the simulated neon sign of FIG. 1.

FIG. 4 shows a B-B cross section of FIG. 1. The cover member 8 inner edges 22 mate with the base 6 inner edges 20. The cover member 8 diffuses light emitted from the LEDs 16. Inked portions 10 of the cover member 8 prevent light from radiating, forming a light mask that defines the contours of letters and images in the cover member 8. The mounting posts 27 support the PCB 17 on which individual LEDs 16 are mounted. The concavity 18 surrounds the series of LEDs 16 in a channel like structure.

Figure 5:
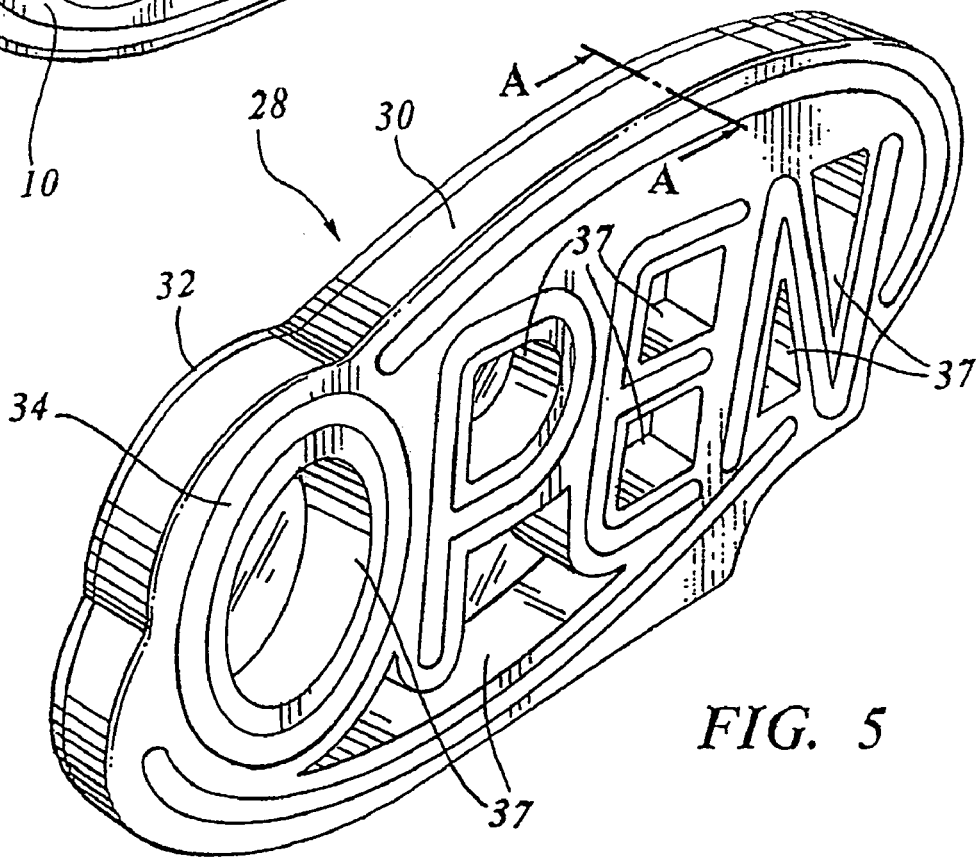
FIG. 5 is a perspective view of an alternate embodiment of the simulated neon sign.

FIG. 5 shows a perspective view of an alternate embodiment of the simulated neon sign. The neon sign simulator includes a housing 28 that approximates the profile of the indicia of a message to be conveyed. Openings 37 on the top of the housing 28 further complement the profile. In this case, the indicia include the lettering for the word "OPEN" with an upper and lower design. The housing 28 includes a bottom 32, a top 30, and a plurality of translucent segments 34 that collectively define the message to be conveyed. The top is composed of a transparent plastic material. The bottom 32 is composed of transparent lightweight rigid plastic. The translucent segments 34 are acrylic with a diffusive frosting.

Figure 6:
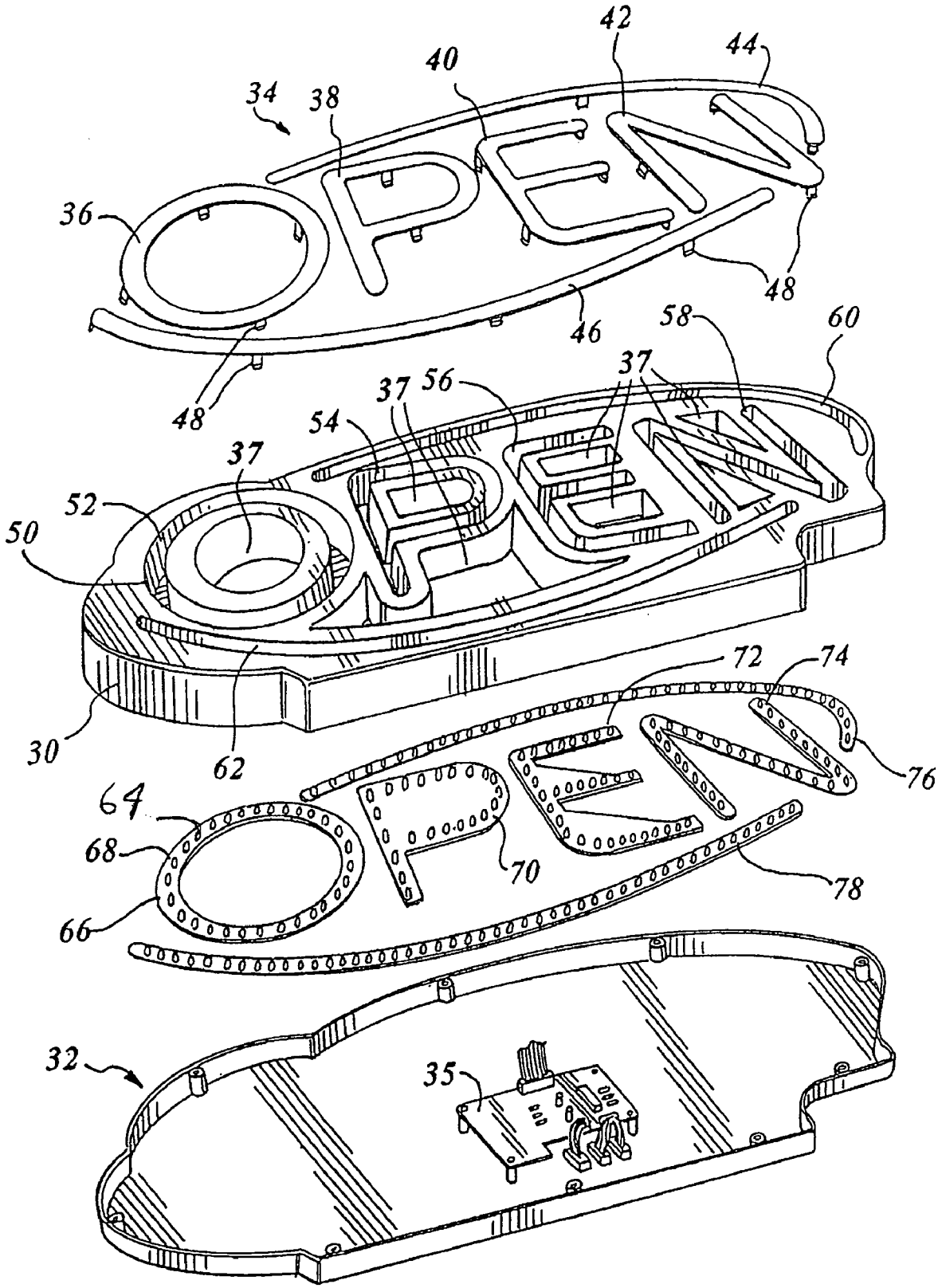
FIG. 6 is an exploded view of the simulated neon sign of FIG. 5.

FIG. 6 shows an exploded view of the simulated neon sign of FIG. 5. The plurality of translucent segments 34 include an "O" 36, "P" 38, "E" 40, "N" 42, an upper curvilinear design 44 and a lower curvilinear design 46. The translucent segments 34 collectively convey the message "open". Each of the translucent segments 34 has one or more latching members 48 for engagement with the top 30 (explained hereinafter). The translucent segments 34 have a domed shape that simulates the cylindrical glass tubing of a neon light.

The top 30 has multiple concavities 50 that accommodate the plurality of translucent segments 34. Individual concavities "O" 52, "P" 54, "E" 56, "N" 58, upper curvilinear design 60 and lower curvilinear design 62 accommodate respective translucent segments 36 38 40 42 44 and 46. Openings 37 in the top 30 further accentuate the lettering. The top 30 has a textured outer surface with dull opaque appearance. The top 30 is composed of Acrylonitrile-Butadiene Styrene (ABS).

A plurality of Light Emitting Diodes (LEDs) 64 are mounted on a plurality of printed circuit boards 66 that extend into the bottoms of the multiple concavities. Each of the printed circuit boards 68 70 72 74 76 78 correspond to each of the concavities 52 54 56 58 60 62 respectively. The diodes generate light that exits through the plurality of translucent segments 34. The diffused light that emanates from the translucent segments has a uniform colored glow similar to the light emitted from a neon light.

The bottom 32 mates with the top 30. A control circuit 35 mounted to the bottom is wired to each of the printed circuit board 66 68 70 72 74 76 78 and controls illumination of the LEDs 66.

Figure 7:
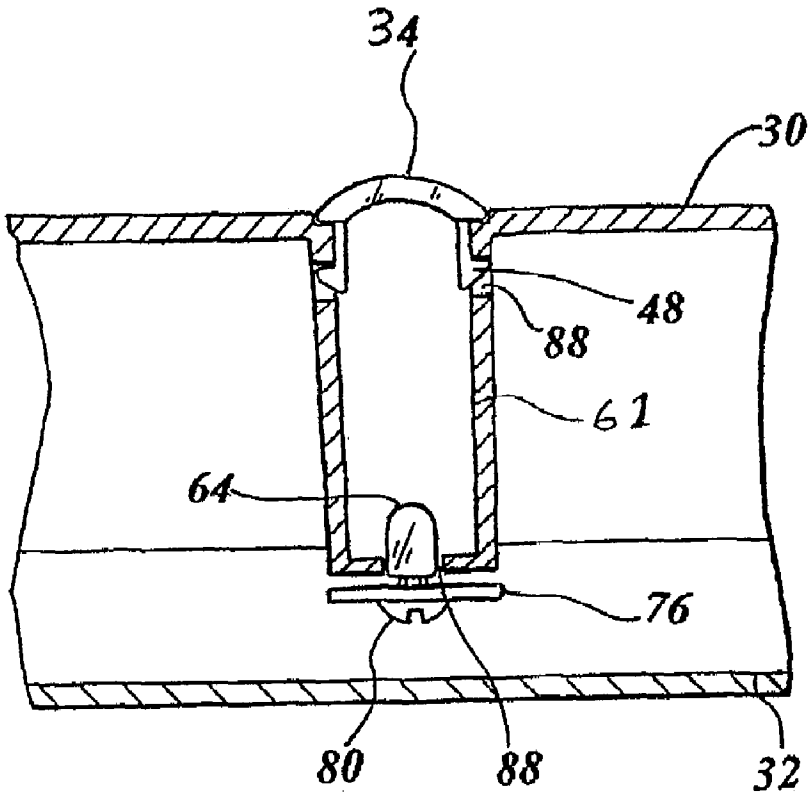
FIG. 7 is an A-A cross section view of the simulated neon sign of FIG. 5.

FIG. 7 shows the A-A cross section of the simulated neon sign of FIG. 5. Translucent segment 34 engages with the top 30 through latching member 48. Latching member 48 engages with notch 88 located in the concavity 61. The concavity 61 has a plurality of apertures 88 through which the LEDs 64 extend. The LEDs 64 are mounted on the PCB 76 that is affixed to the bottom of the concavity with screws 80.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A lighting apparatus viewable to a user comprising:

a base including a first plurality of portions defining a first plurality of openings, and a plurality of portions defining a plurality of concavities;

a plurality of light emitting diodes (LEDs) located within the concavities for emitting light; and a flat translucent cover member mated to the base for diffusing light including a second plurality of portions defining a second plurality of openings, the second plurality of openings corresponding in location to the first plurality of openings, and a plurality of opaque inked portions located on a first side of the translucent cover member defining translucent indicia viewable to the user, the translucent indicia illuminated by the LEDs and configured to simulate a size and an appearance of a shaped neon tube in a neon sign, wherein the first plurality of openings, the second plurality of openings, the plurality of opaque inked portions, the translucent indicia, and the plurality of LEDs cooperate with each other to simulate the appearance of the shaped neon tube.

2. The lighting apparatus of claim 1 wherein the translucent cover member includes a second side mated to the first side, the first side and the second side perpendicular to each other to aid in simulating the appearance of the shaped neon tube.

3. The lighting apparatus of claim 2 wherein the opaque inked portions define the translucent indicia to simulate gaps in the shaped neon tube which prevent portions of the shaped neon tube from touching itself.

4. The lighting apparatus of claim 3 wherein the cover member is made substantially of an acrylic material.

5. The lighting apparatus of claim 4 wherein the cover member has a frosted or sanded surface to diffuse light.

6. The lighting apparatus of claim 1 wherein the translucent indicia is lettering, images, or icons.

7. The lighting apparatus of claim 6 wherein ink deposited from a silk screen form the opaque inked portions.

8. The lighting apparatus of claim 1 wherein the plurality of portions defining the plurality of concavities include a smooth inner surface.

9. The lighting apparatus of claim 1 further comprising a control panel that controls a flash rate of the source of illumination.

10. A lighting apparatus viewable to a user comprising:

a base including a first plurality of portions defining a first plurality of openings, and a plurality of portions defining a plurality of concavities;

a flat translucent cover member mated to the base for diffusing light including a second plurality of portions defining a second plurality of openings, the second plurality of openings corresponding in location to the first plurality of openings;

a plurality of opaque inked portions located on the first side of the translucent cover member defining translucent indicia viewable to the user, the translucent indicia configured to simulate a size and an appearance of a neon tube in a neon sign and the opaque inked portions define the translucent indicia to simulate gaps in the shaped neon tube which prevent portions of the neon tube from touching itself;

a second side mated to the first side, the first side and the second side perpendicular to each other to aid in simulating the appearance of the neon tube; and a plurality of LEDs located in the plurality of concavities illuminating the translucent indicia, wherein the first plurality of openings, the second plurality of openings, the plurality of opaque inked portions, and the plurality of LEDS cooperate with each other to simulate the appearance of the neon tube in the neon sign.

11. The apparatus of claim 10 further comprising means for controlling a flash rate of at least one of the plurality of LEDs to simulate the appearance of the neon tube when the neon tube is flashing.

12. The apparatus of claim 11 further comprising means for controlling the light intensity of the LEDs wherein the light intensity of the LEDS simulate a light intensity of the neon tube.

* * * * *